US005704397A

United States Patent [19]

Lu

[11] Patent Number: 5,704,397

[45] Date of Patent: Jan. 6, 1998

[54] WATER FLOW CONTROL DEVICE

[76] Inventor: Ke-Way Lu, 3F. No. 322, Sec. 6, Min-Chuan E. Rd., Taipei City (Green Lake Mansion), Taiwan

[21] Appl. No.: 746,477

[22] Filed: Nov. 12, 1996

Related U.S. Application Data

[63] Continuation-in-part of Ser. No. 585,722, Jan. 16, 1996, Pat. No. 5,651,531.

[51] Int. Cl.[6] ..... F16K 11/10; F16K 11/00; F16K 31/44

[52] U.S. Cl. ..... 137/630.15; 74/110; 74/575; 137/801; 239/583; 251/229; 251/230; 251/263; 251/319; 251/339; 251/347

[58] Field of Search ..... 4/678; 137/630.14, 137/630.15, 798, 801, 901; 239/583; 251/229, 230, 251, 319, 339, 347, 263; 74/110, 575

[56] References Cited

U.S. PATENT DOCUMENTS

| | | | |
|---|---|---|---|
| 896,468 | 8/1908 | Schreidt | 137/630.14 |
| 1,217,579 | 2/1917 | Dudley | 251/118 |
| 1,498,191 | 6/1924 | Morrison | 137/630.14 |
| 1,807,970 | 6/1931 | Davis | 137/630.14 |
| 1,821,206 | 9/1931 | Caswell | 137/630.14 |
| 1,998,913 | 4/1935 | Wheaton | 137/630.14 |
| 2,254,308 | 9/1941 | Nicholas | 137/630.14 |
| 2,763,407 | 9/1956 | Rowell | 137/630.14 |
| 3,032,063 | 5/1962 | Wells | 137/630.15 |
| 3,114,391 | 12/1963 | Kurtz | 137/630.14 |
| 3,220,695 | 11/1965 | Downey et al. | 251/230 |
| 3,333,815 | 8/1967 | Downey et al. | 251/230 |
| 3,730,224 | 5/1973 | Prisk | 251/118 |
| 4,181,987 | 1/1980 | Kesselman | 137/901 |
| 4,344,457 | 8/1982 | Carroll | 251/118 |
| 4,456,222 | 6/1984 | Shen | 251/230 |
| 4,494,562 | 1/1985 | Stephens | 251/118 |
| 4,506,860 | 3/1985 | Von Schwerdtner et al. | 251/118 |
| 4,667,349 | 5/1987 | Son | 137/801 |
| 4,771,985 | 9/1988 | Gross et al. | 251/230 |
| 4,840,351 | 6/1989 | Lii | 251/230 |
| 4,981,160 | 1/1991 | Sen-Tein | 137/801 |
| 5,018,703 | 5/1991 | Goode | 251/118 |
| 5,067,517 | 11/1991 | Ting-Chih et al. | 137/801 |
| 5,361,804 | 11/1994 | Keller et al. | 137/801 |
| 5,456,448 | 10/1995 | Chou | 251/230 |

*Primary Examiner*—George L. Walton
*Attorney, Agent, or Firm*—Ladas & Parry

[57] ABSTRACT

A water flow control device including a control valve mounted in a casing and controlled by a control rod through an actuating rod to close/open the water discharging port, the control valve including a valve flap having a center hole and a plurality of axial ribs axially downwardly extended from the periphery of the center hole and being moved to close/open the water discharging port of the upright tube of the casing, an axle having a bottom end inserted through the center hole of the valve flap and a top end vertically slidably inserted into a downward bottom hole in the cup-shaped holder of the cup-like casing mounting base, a valve element fixedly mounted around the axle in the middle and moved with it to open/close the center hole of the valve flap, and a stem fixedly connected to the bottom end of the axle and moved by the actuating rod to lift the valve flap from the upright tube of the casing.

2 Claims, 3 Drawing Sheets

WATER FLOW CONTROL DEVICE

This application is a continuation-in-part of application Ser. No. 08/585,722 filed Jan. 16, 1996 U.S. Pat. No. 5,561,531.

BACKGROUND OF THE INVENTION

The present invention involves the field of technology pertaining to water flow control devices. More particularly, the invention relates to an improved structure of water flow control device which releases excessive high water pressure before it is fully opened and, which has buffer means to buffer rush water.

U.S. patent application Ser. No. 08/585,722, U.S. Pat. No. 5,651,531 discloses a water flow control device which comprises a cup-like mounting base fastened to the water discharging pipe of a water supply system, a casing fastened to the cup-like mounting base, a control valve mounted inside the cup-like mounting base and the casing and moved to open/close the waster passage between the cup-like mounting base and the casing, a control rod mounted in the casing for moving by hand, a rotary actuating rod o coupled between the control valve and the control rod and moved by the control rod to force the control valve into the open position or the closed position, and a locating mechanism made on the inside of an upright tube inside the casing for holding the control rod and the rotary actuating rod in place. This structure of water flow control device is functional, however it still has drawbacks. When the pressure of water is high, much effort must be employed to push the control rod upwards. Furthermore, when rush water flows out of the device, it splashes over the sink.

SUMMARY OF THE INVENTION

It is one object of the present invention to provide a water flow control device which releases water pressure partially before it is fully opened. It is another object of the present invention to provide a water flow control device which has buffer means to buffer rush water. According to one aspect of the present invention, the water flow control device comprises a control valve mounted in a casing and controlled by a control rod through an actuating rod to close/open the water discharging port, the control valve including a valve flap having a center hole and a plurality of axial ribs axially downwardly extended from the periphery of the center hole and being moved to close/open the water discharging port of the upright tube of the casing, an axle having a bottom end inserted through the center hole of the valve flap and a top end vertically slidably inserted into a downward bottom hole in the cup shade holder of the cup-like casing mounting base, a valve element fixedly mounted around the axle in the middle and moved with it to open/close the center hole of the valve flap, and a stem fixedly connected to the bottom end of the axle and moved by the actuating rod to lift the valve flap from the upright tube of the casing. According to another aspect of the present invention, the upright tube of the casing has a plurality of radial ribs raised around the periphery and projecting into a part of said water discharging port, and a buffer ring is fixedly mounted around on the radial ribs of the upright tube of the casing to buffer the discharging of water from the water discharging port.

DETAILED DESCRIPTION OF THE PREFERRED EMBODIMENT

Figure 1:
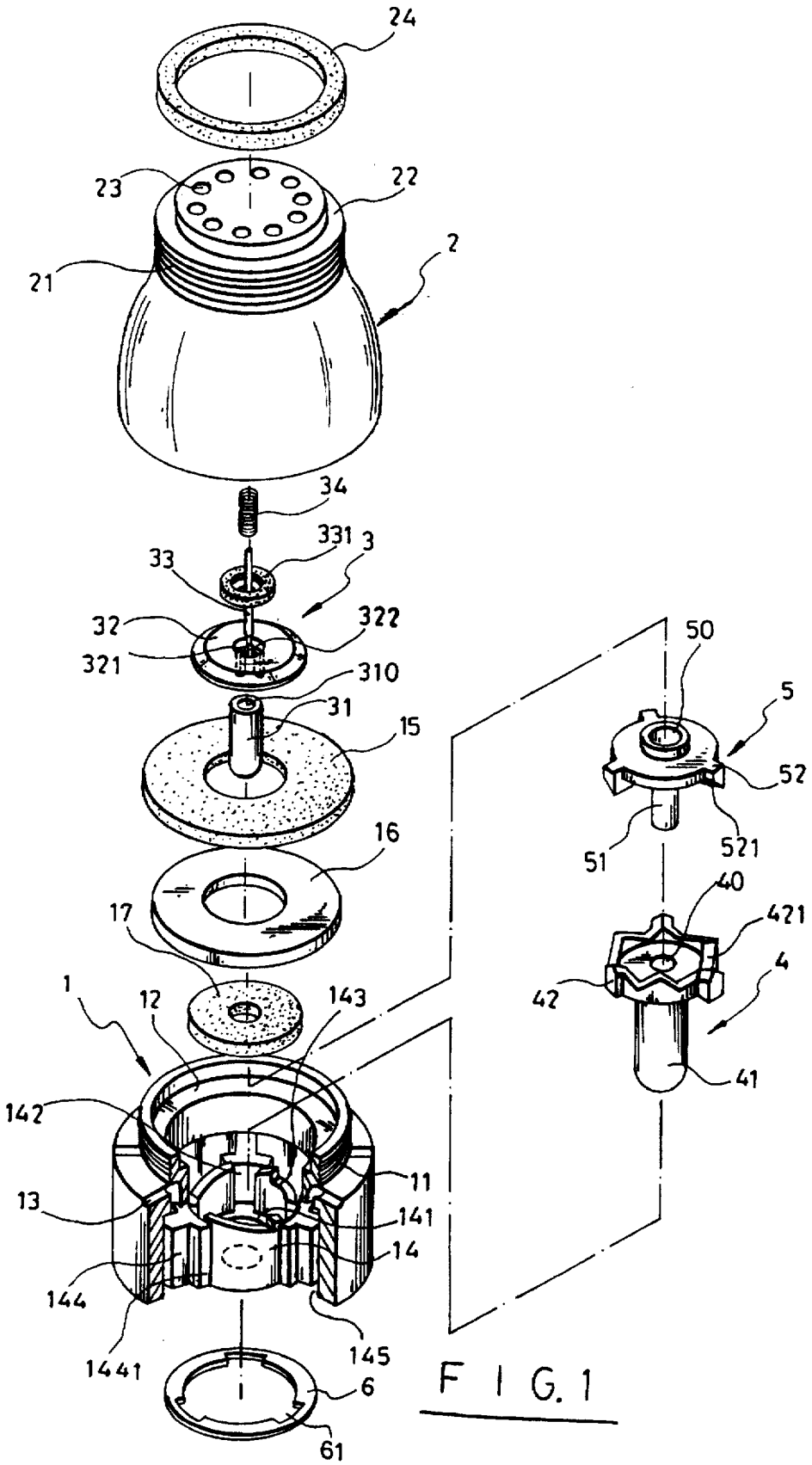
FIG. 1 is an exploded view of a water flow control device according to the present invention.
Figure 2:
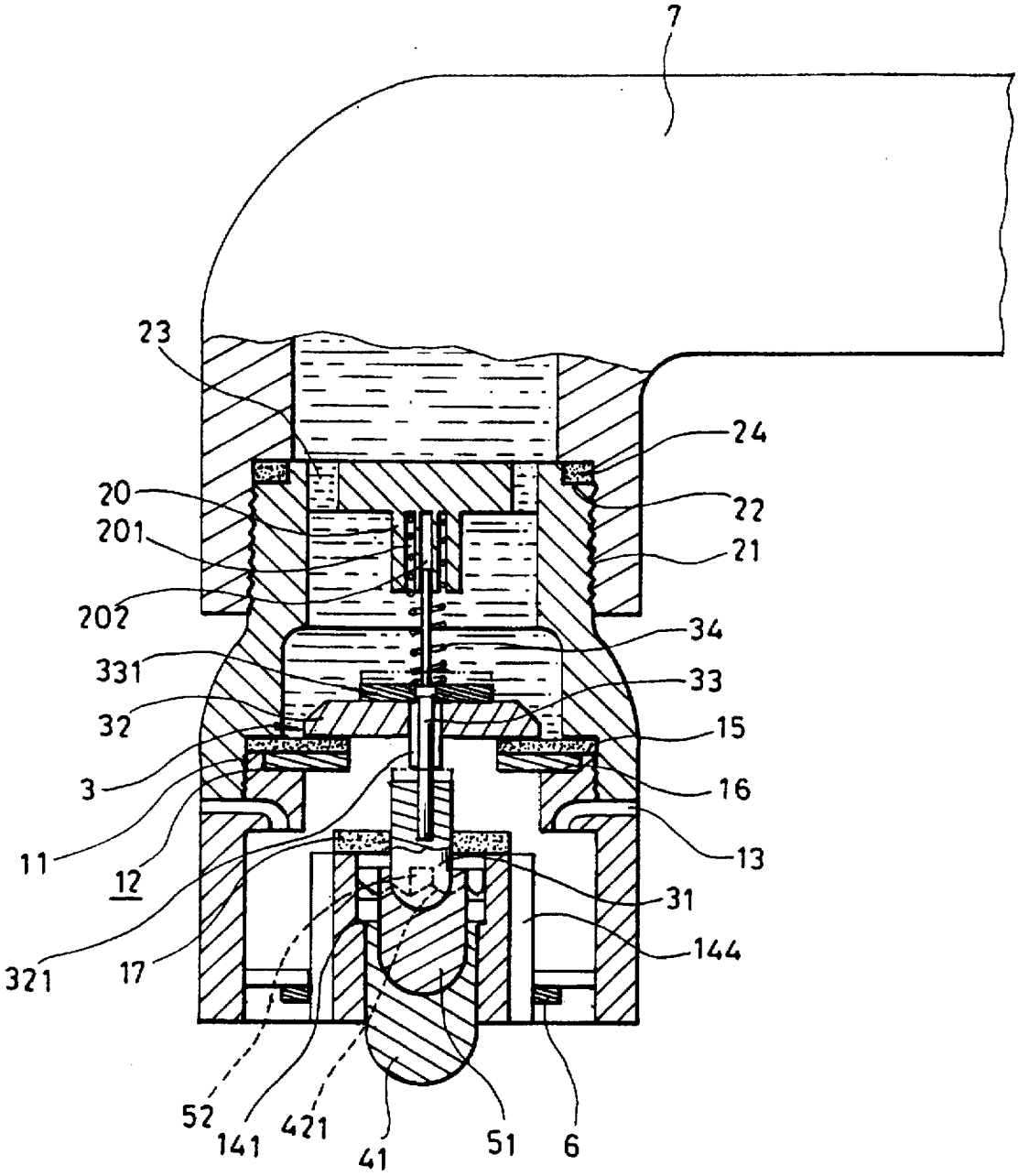
FIG. 2 is a sectional assembly view of the water flow control device shown in FIG. 1, showing the water passage closed; and, FIG. 3 is similar to FIG. 2 but showing the control valve lifted, and the water passage opened.

Referring to FIGS. 1 and 2, a water flow control device in accordance with the present invention is generally comprised of a casing 1, a cup-like mounting base 2, a control valve 3, a control rod 4, a rotary actuating rod 5, and a locating mechanism made on the inside of the casing 1. The casing 1 is made of hollow cylindrical shape comprising a plurality of radial air vents 13 for the passing of air between the inside of the casing 1 and the outside thereof, a threaded mounting neck 11 for fastening to the cup-like mounting base 2, an inside annular flange 12 raised around the threaded mounting neck 11 on the inside for mounting a plastic washer 16 and a valve seat 15 above the plastic washer 16, an upright tube 14 that extends upwardly from the outlet end of the casing 1 along a center axis, a water discharging port 145 at the bottom side around the upright tube 14, a plurality of radial ribs 144 connected between the bottom end of the upright tube 14 and the bottom end of the casing 1. Each radial rib 144 has two guide flanges 1441 longitudinally raised along two opposite lateral sides. The upright tube 14 has a seal means 17 disposed at its upper end intermediate the casing 1 for slidably receiving the control rod 31, an inside annular flange 141 around the inside wall at the bottom side. A buffer ring 6 is mounted around the upright tube 14 at the bottom and fixedly secured thereto by a bonding agent, having a plurality of inside notches 61 which receive the radial ribs 144.

Figure 3:
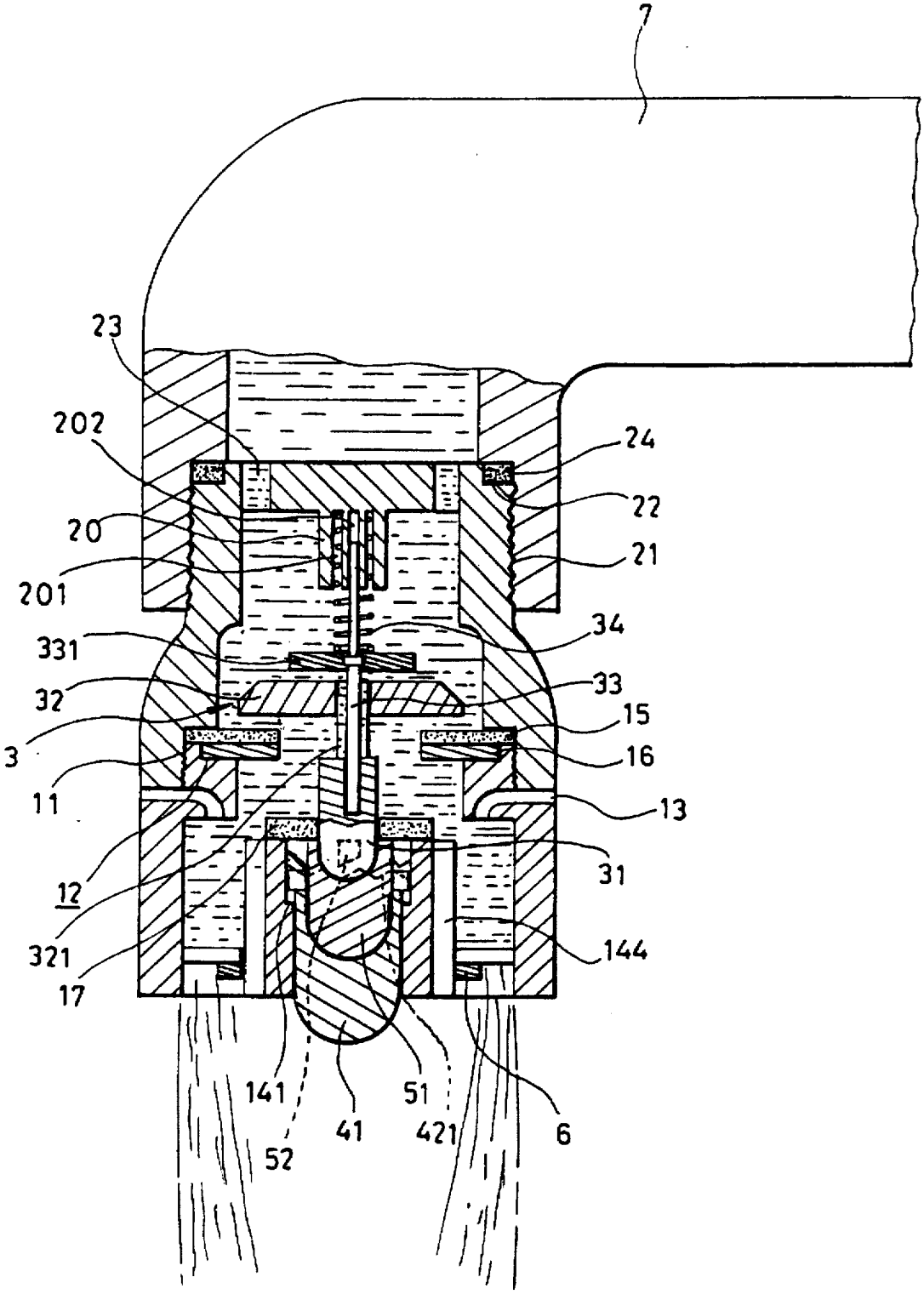

Referring to FIG. 3, and FIGS. 1 and 2 again, the aforesaid locating mechanism comprises a plurality of longitudinal grooves 142 equiangularly spaced around the inside wall of the upright tube 14, a plurality of bevel top edges 143 at the top of the upright tube 14 at different elevations. The control rod 4 comprises a head 42 stopped above the inside annular flange 141 and moved along the longitudinal grooves 142 and having a serrated top edge 421 around the border, an elongated rod body 41 extending downwards from the head 42 and extending out of the inside annular flange 141 of the upright tube 14 and defining an axial top hole 40 for receiving the rotary actuating rod 5. When the control rod 4 is installed, it can be moved longitudinally in the upright tube 14. The rotary actuating rod 5 comprises a rod body 51 inserted into the top hole 40 of the control rod 4, a top hole 50 for receiving the control valve 3, and a plurality of locating blocks 52 raised around the top end of the rod body 51. The locating blocks 52 have a respective bevel bottom edge 521 respectively disposed in contact with the bevel top edges 143 of the upright tube 14. The bevel bottom edges 521 of the locating blocks 52 slope in the same direction as that of the bevel top edges 143, therefore the locating blocks 52 can be moved along the bevel top edges 143. By turning the rotary actuating rod 5 relative to the inside upright tube 14, the locating blocks 52 can be moved into engagement with the longitudinal grooves 142. When the locating blocks 52 are moved into the longitudinal grooves 142 and stopped above the head 42 of the control rod 4, the rotary actuating rod 5 is disposed at the low level position.

Referring to FIGS. 1 and 2 again, the cup-like mounting base 2 is internally threaded and threaded onto the threaded mounting neck 11 of the casing 1, having an outer thread 21 adapted for threading into the internally threaded water discharging pipe 7 of a faucet or water supply system, a water input port 23 at the top for guiding water from the water discharging pipe 7 to the casing 1, a step 22 above the outer thread 21 around the water input port 23, a water sealing ring 24 mounted around the step 22, and a cup-shaped holder 20 which extends along a center axis and downward into the casing mounting base 2. The cup-shaped holder 20 comprises a downward center hole 202, and an annular spring mounting hole 201 around the downward center hole 202. The control valve 3 comprises a valve flap 32 having a center hole 321 and a plurality of axial ribs 322 axially extended from the periphery of the center hole 321, an axle 33, a valve element 331 fixedly mounted around the axle 33 in the middle, and a spring 34 mounted in the spring mounting hole 201 and spaced around the axle 33 and stopped between the casing mounting base 2 and the valve element 331, and a stem 31 inserted into the top hole 50 of the actuating rod 5 and having a top center hole 310. The axle 33 has a top end inserted into the downward center hole 202 of the cup shape holder 20, and a bottom end inserted through the center hole 321 of the valve flap 32 and fitted into the top center hole 310 of the stem 31. The spring 34 imparts a downward pressure to the valve element 331, causing it to seal the center hole 321 of the valve flap 32.

Referring to FIG. 3 and FIG. 2 again, when the water flow control device is installed, the locating blocks 52 are disposed at the low level position, and the valve flap 32 is forced by water pressure to seal the valve seat 15; when the user pushes the rod body 41 of the control rod 4 upwards with the hand, the rotary actuating rod 5 will be lifted upwards, causing the stem 31 to lift the axle 33. When the axle 33 is lifted, the valve element 331 is moved upwardly away from the center hole 321 of the valve flap 32, permitting water pressure to be partially released. When the control rod 4 is continuously lifted, the actuating rod 5 will be moved to the high level position and will be stopped above the bevel top edges 143 of the upright tube 14, and the valve flap 32 is lifted from the valve seat 15, permitting water to pass from the cup-like mounting base 2 to the casing 1, and then to further flow out of the casing 1 through the water discharging port 145 (see FIG. 3).

It is to be understood that the drawings are designed for purposes of illustration only, and are not intended as a definition of the limits and scope of the invention disclosed.

I claim:

1. A water flow control device comprising:

a cup-like mounting base for fastening to a water discharging pipe of a water supply system, said cup-like mounting base having a cup-shaped holder inside and a water input port for passing water from the water discharging pipe;

a hollow cylindrical casing fastened to said cup-like mounting base, said hollow cylindrical casing having a central upright tube and a water discharging port around said upright tube, the upright tube having a plurality of radial ribs projecting into a part of said water discharging port, a buffer ring being fixedly mounted around and on said radial ribs to buffer the discharging water from said water discharging port;

a control rod mounted in said casing for moving by hand;

a rotary actuating rod coupled to and moved by said control rod; and a control valve mounted in between said mounting base and said casing and moved by said control rod through said actuating rod to control the passage between the water input port of said mounting base and the water discharging port of said casing, said control valve comprising:

a valve flap having a center hole and a plurality of axial ribs axially extending from the a periphery of the center hole and away from said cup-like mounting base, said valve flap being movable to open and close the water discharging port of the upright tube of said casing;

an axle having a bottom end inserted through the center hole of said valve flap and a top end vertically slidably inserted into a downward bottom hole in the cup-shaped holder of said cup-like mounting base;

a valve element fixedly mounted around said axle, said valve element being movable with said axle to open and close the center hole of said valve flap; and a stem fixedly connected to the bottom end of said axle, said stem being movable by said actuating rod to lift said valve flap from the upright tube of said casing;

wherein said valve flap is forced by water pressure to close said water discharging port, and wherein, when said control rod is pushed toward said cup-like mounting base, said rotary actuating rod is lifted toward said cup-like mounting base, thereby causing said stem to lift said axle so that said valve element is moved toward said cup-like mounting base and away from the center hole of said valve flap, thereby permitting water to flow through said water discharging port.

2. A water flow control device as claimed in claim 1 further comprising a spring mounted around said axle and stopped between an inside wall of the cup-shaped holder of said cup-like mounting base and said valve element to bias said valve element away from said cup-like mounting base.

* * * * *